US006631886B1

(12) United States Patent
Caudle et al.

(10) Patent No.: US 6,631,886 B1
(45) Date of Patent: Oct. 14, 2003

(54) WINCH HOUSING WITH INTEGRAL FAIRLEAD

(75) Inventors: Richard L. Caudle, Wagoner, OK (US); Todd C. Lehmann, Wagoner, OK (US)

(73) Assignee: Ramsey Winch Company, Tulsa, OK (US)

( * ) Notice: Subject to any disclaimer, the term of this patent is extended or adjusted under 35 U.S.C. 154(b) by 0 days.

(21) Appl. No.: 09/903,470

(22) Filed: Jul. 11, 2001

(51) Int. Cl.[7] ..... B66D 1/36

(52) U.S. Cl. ..... 254/327; 254/336; 254/338; 254/344

(58) Field of Search ..... 254/327, 336, 254/338, 344

(56) References Cited

U.S. PATENT DOCUMENTS

| | | | | |
|---|---|---|---|---|
| 490,984 A | * | 3/1893 | Pine | 254/336 |
| 2,389,177 A | * | 11/1945 | Ball | 254/344 |
| 2,738,143 A | * | 3/1956 | Hannay | 254/336 |
| 3,309,066 A | * | 3/1967 | Carlson | 254/344 |
| 3,788,605 A | | 1/1974 | Johnson | 254/150 FH |
| 3,876,183 A | | 4/1975 | Strout et al. | 254/175.7 |
| 3,985,047 A | | 10/1976 | Therkelsen | 74/805 |
| 3,994,477 A | | 11/1976 | Bexten | 254/190 R |
| 4,004,780 A | | 1/1977 | Kuzarov | 254/187.4 |
| 4,030,776 A | | 6/1977 | Bricknell et al. | 280/477 |
| 4,296,917 A | | 10/1981 | Day et al. | 254/400 |
| 4,400,132 A | * | 8/1983 | Deline et al. | 254/327 |
| 4,449,697 A | | 5/1984 | Hicks | 254/297 |
| 4,552,340 A | | 11/1985 | Sheppard | 254/358 |
| 4,635,875 A | | 1/1987 | Apple | 242/155 BW |
| 4,650,163 A | * | 3/1987 | Peterson | 254/327 |
| 4,722,293 A | | 2/1988 | Foster et al. | 114/230 |
| 4,736,929 A | | 4/1988 | McMorris | 254/344 |
| 4,742,993 A | | 5/1988 | Montgomery et al. | 254/389 |
| 4,921,219 A | * | 5/1990 | Ottemann et al. | 192/48.92 |
| 5,634,628 A | | 6/1997 | Schuch | 254/331 |

FOREIGN PATENT DOCUMENTS

| | | | | |
|---|---|---|---|---|
| EP | 0571207 A1 | * | 11/1993 | 254/338 |
| JP | 05008996 A | * | 1/1993 | B66D/1/38 |

* cited by examiner

*Primary Examiner*—Kathy Matecki
*Assistant Examiner*—Sang Kim
(74) *Attorney, Agent, or Firm*—Roger N. Chauza, Esq.; Chauza & Handley, LLP

(57) ABSTRACT

A winch constructed with a fairlead frame providing a mounting base for the winch and providing a rotational support for a cable drum. Loads exerted on a cable and through the fairlead rollers and cable drum are transferred to the unitary fairlead frame members, and thus to the base to which the winch is mounted.

20 Claims, 4 Drawing Sheets

WINCH HOUSING WITH INTEGRAL FAIRLEAD

TECHNICAL FIELD OF THE INVENTION

The present invention relates in general to hoists and winches, and more particularly to winches utilizing fairlead structures for guiding cables.

BACKGROUND OF THE INVENTION

Hoists and winches are typically employed to lift or pull heavy loads. With the popularity of off-road vehicles and all-terrain vehicles, winches are now offered either as original purchase options or after market products. A vehicle-mounted winch is commonly utilized to either pull the vehicle toward a fixed object, or to pull an object, such as a fallen tree or other debris, to clear a path.

It is a common practice in winch construction to utilize a wire rope or cable wrapped on a power-driven drum. The strength of the gears and the torque of the motor, as well as the cable diameter generally determine the load that can be safely applied between the object and the winch. In order to prevent damage to the cable, and more particularly from allowing the cable strands to be abraided or bent at sharp angles, fairlead structures are employed to facilitate the routing of the cable onto the drum. A number of rollers or smooth curved surfaces are typically employed at the entrance of the drum to provide a rolling or smooth surface and prevent abrasion or severe bending of the cable.

It is a conventional practice to fabricate the fairlead structure separate from the winch, and then bolt the parts together. This is illustrated in U.S. Pat. No. 4,736,929. While this allows a substantial degree of flexibility in utilizing a few models or types of fairleads with many different types of winches, the use of separate items generally increases the cost and assembly time of the winch.

Disclosed in U.S. Pat. No. 3,985,047 is a winch drive mechanism in which the fairlead structure is made integral with the overall housing of the winch. Because of the manner in which this type of winch is constructed with an integral fairlead, manufacturing costs are believed to be increased, and a breakage or bending of the fairlead necessitates the replacement of the entire housing of the winch.

From the foregoing, it can be seen that a need exists for a technique for constructing a winch having integral therewith the fairlead. Another need exists for a rigid and sturdy fairlead structure which also serves as a bearing housing for the cable drum.

SUMMARY OF THE INVENTION

The present invention disclosed and claimed herein, in one, aspect thereof includes a fairlead fabricated integral with the winch structure to overcome the problems and shortcomings of the prior art winches.

In accordance with an important feature of the invention, the fairlead includes spaced-apart frame members for supporting a pair of vertical rollers and a pair of horizontal rollers to provide a rolling guide surface for the cable. The spaced-apart frame members have bores formed therein for supporting respective bearings for the cable drum. Molded plastic ring gear housings are mounted to the respective fairlead frame members. The motor ring gear housings support therein the planetary gear reduction assemblies which are driven by a DC motor attached to one ring gear housing. Attached to the other ring gear housing is a clutch assembly. The winch constructed according to the foregoing is easily assembled with fewer parts than many winches of the prior art.

BRIEF DESCRIPTION OF THE DRAWINGS

Further features and advantages will become apparent from the following description of the drawings, in which like reference characters generally refer to the same parts, elements, or functions throughout the views, and in which.

DETAILED DESCRIPTION OF THE INVENTION

Figure 1:
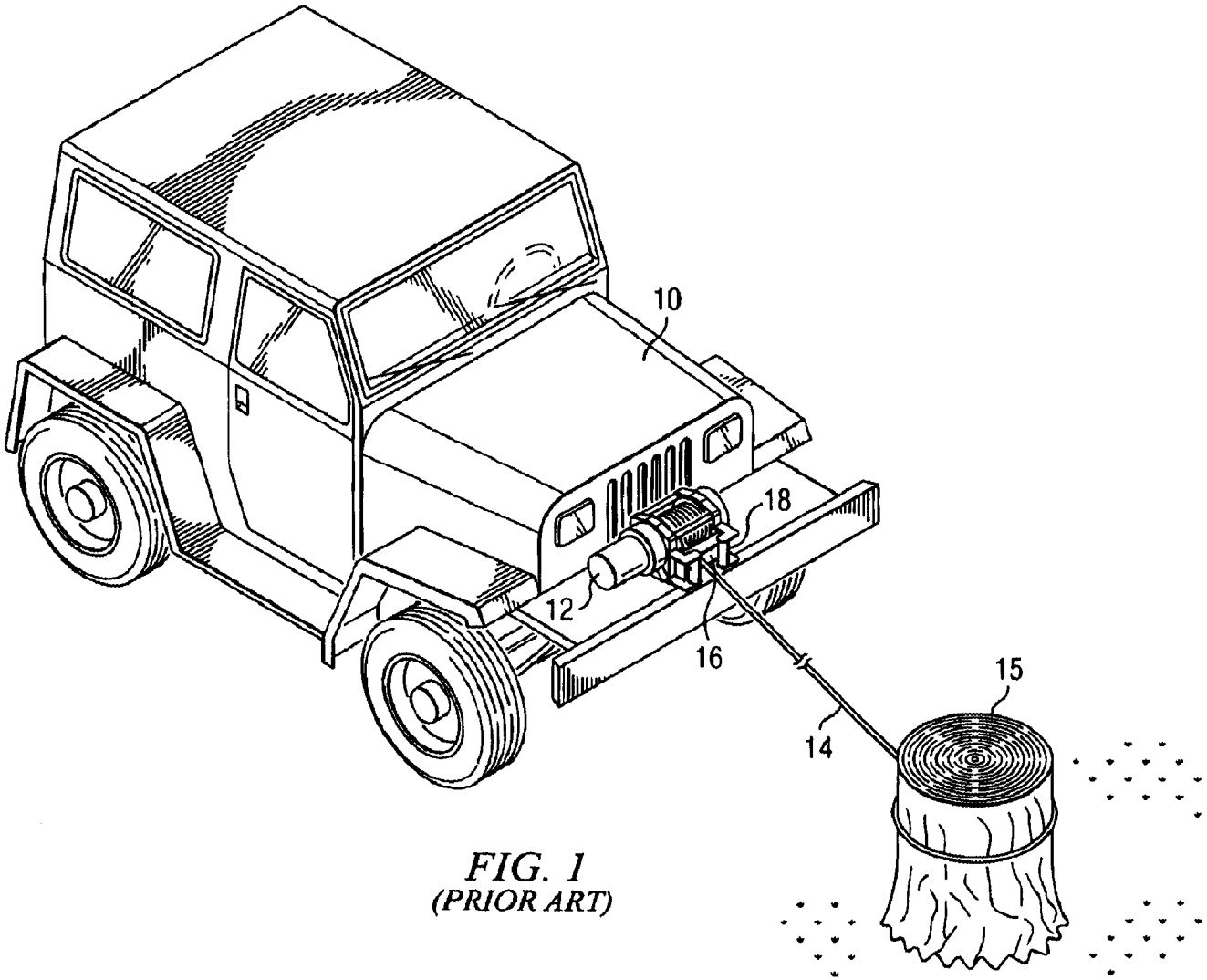
FIG. 1 (PRIOR ART)
FIG. 1 illustrates a conventional vehicle-mounted winch employing a fairlead to guide the cable to the wind-up drum.

FIG. 1 illustrates a typical application of an off-road vehicle, or the like, employing a winch 12 with a cable 14 wrapped around and anchored to a stump 15. The vehicle 10 is shown not aligned with the stump 15, and thus the cable 14 is directed to the winch 12 at an angle. In order to prevent abrasion of the cable 14 on rough edges of the winch 12, a fairlead structure is provided. Fairleads typically include a pair of horizontal rollers, one shown as reference numeral 16, and a pair of vertical rollers, one shown as reference numeral 18. The rollers provide a smooth entrance surface to the wind-up drum for the cable 14. As can be appreciated, a major stress is exerted by the cable 14 not only on the fairlead rollers 16 and 18, but also on the wind-up drum of the winch 12.

Figure 2:
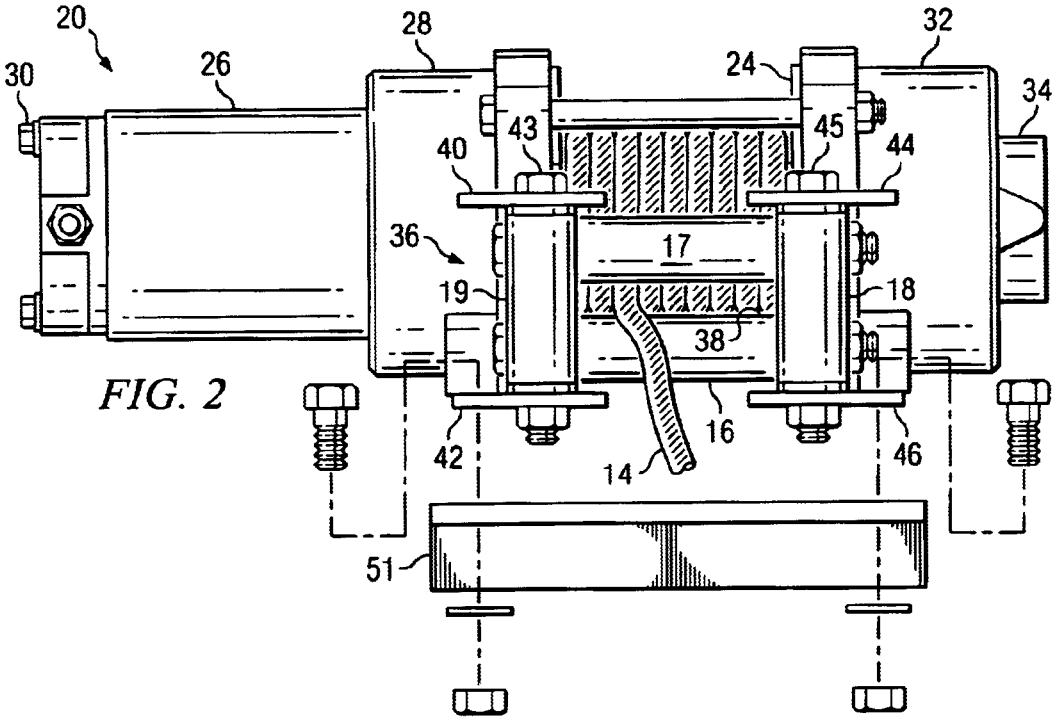
FIG. 2 is a frontal view of the winch and integral fairlead constructed according to a preferred embodiment.
Figure 3:
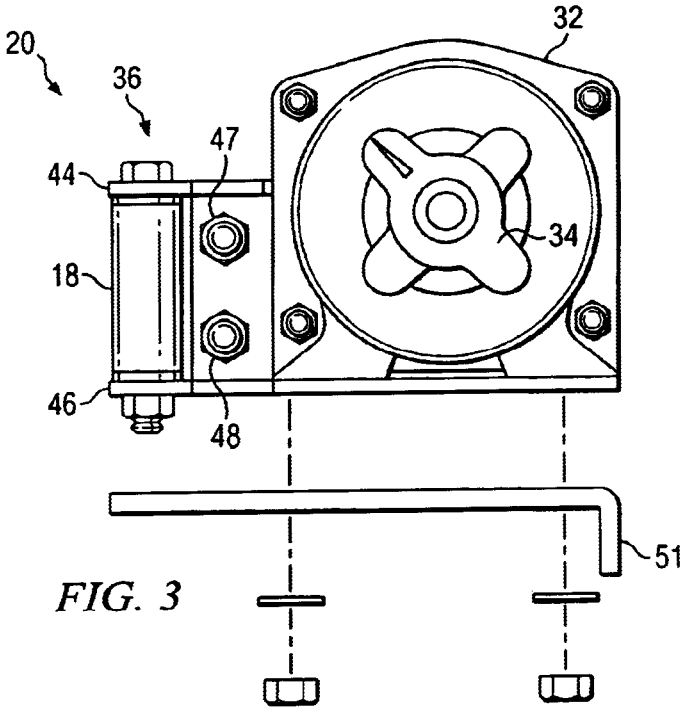
FIG. 3 is a right side view of the winch of FIG. 2.

FIG. 2 is a frontal view of the winch 20 constructed in accordance with the principles and concepts of the invention, and FIG. 3 is a right side view of FIG. 2. The winch 20 includes a DC motor 26 fastened to a motor ring gear housing 28 by plural bolts, one shown as reference numeral 30. The motor ring gear housing 28 is constructed of a lightweight moldable material, such as a plastic, nylon 6/6, carbon fiber, etc. Formed on the internal annular surface of the motor ring gear housing 28 are a number of gear teeth. A number of planetary gears (not shown) are housed within the motor ring gear housing 28 for engagement with the teeth formed in the housing 28. A shaft coupling the planetary gears is coupled through the tubular spindle of the cable drum 24, and extends into a clutch ring gear housing 32. The clutch ring gear housing 32 also has teeth molded on an internal annular surface thereof for engagement with an additional set of planetary gears. The clutch ring gear housing 32 is formed with a lightweight moldable material, in the same manner as the motor ring gear housing 28. A manually-operated clutch 34 is provided to either engage or disengage the cable drum 24 from the planetary gear mechanisms. The clutch 34 can be disengaged to allow the cable drum 24 to operate freely when unwinding the cable 14 from the drum 24. The planetary gear mechanisms and the clutch are of standard design and are not illustrated.

While the spaced-apart frame members of the winch 20 provide a base for mounting to a vehicle, the base of the fairlead frame members can also be mounted to an auxiliary mounting plate 51. The auxiliary mounting plate 51 can be made as part of a kit for mounting the winch 20 to many different types of frames or vehicles. The auxiliary mounting plate 51 is preferably made of a light weight, strong material, such as carbon fiber, or a carbon fiber filled synthetic material, plastic or nylon of a suitable strength. A number of holes can be formed in the auxiliary mounting plate 51 so as to be universal, in that it can be bolted to a number of different vehicle frames.

In accordance with an important feature of the invention, a fairlead 36 is mounted integral with the components of the winch 20. FIGS. 2 and 3 illustrate a generalized view of the fairlead 36 as mounted to the winch 20. The fairlead 36 includes a pair of spaced-apart vertically-oriented rollers 18 and 19, and a pair of spaced-apart horizontal rollers 16 and 17. Each roller 16–19 is mounted to spaced-apart fairlead frame members (not shown in FIGS. 2 and 3) which function to support the cable drum 24. A window or entrance opening 38 formed by the pairs of vertical and horizontal rollers provides a smooth surface for the cable 14 to be routed therethrough and either wound or unwound onto the cable drum 24. As noted above, the fairlead rollers substantially reduce any abrading, undue wear or breakage of the strands of wire which form the cable 14.

The left vertical roller 19 is supported between a top ear 40 and a bottom ear 42, both ears of which are integral with the left fairlead frame member. In like manner, the right vertical roller 18 is supported between a top ear 44 and a bottom ear 46 which constitute part of the right fairlead frame member. Bolts 43 and 45 are utilized to mount thereto the respective vertical rollers 19 and 18. The top horizontal roller 17 is supported between the left fairlead frame member and the right fairlead frame member. The bottom horizontal roller 16 is similarly supported between the left and right fairlead frame members. As shown in FIG. 3, bolts 47 and 48 extend between the left and right fairlead frame members to support the respective horizontal rollers 17 and 16.

Figure 4:
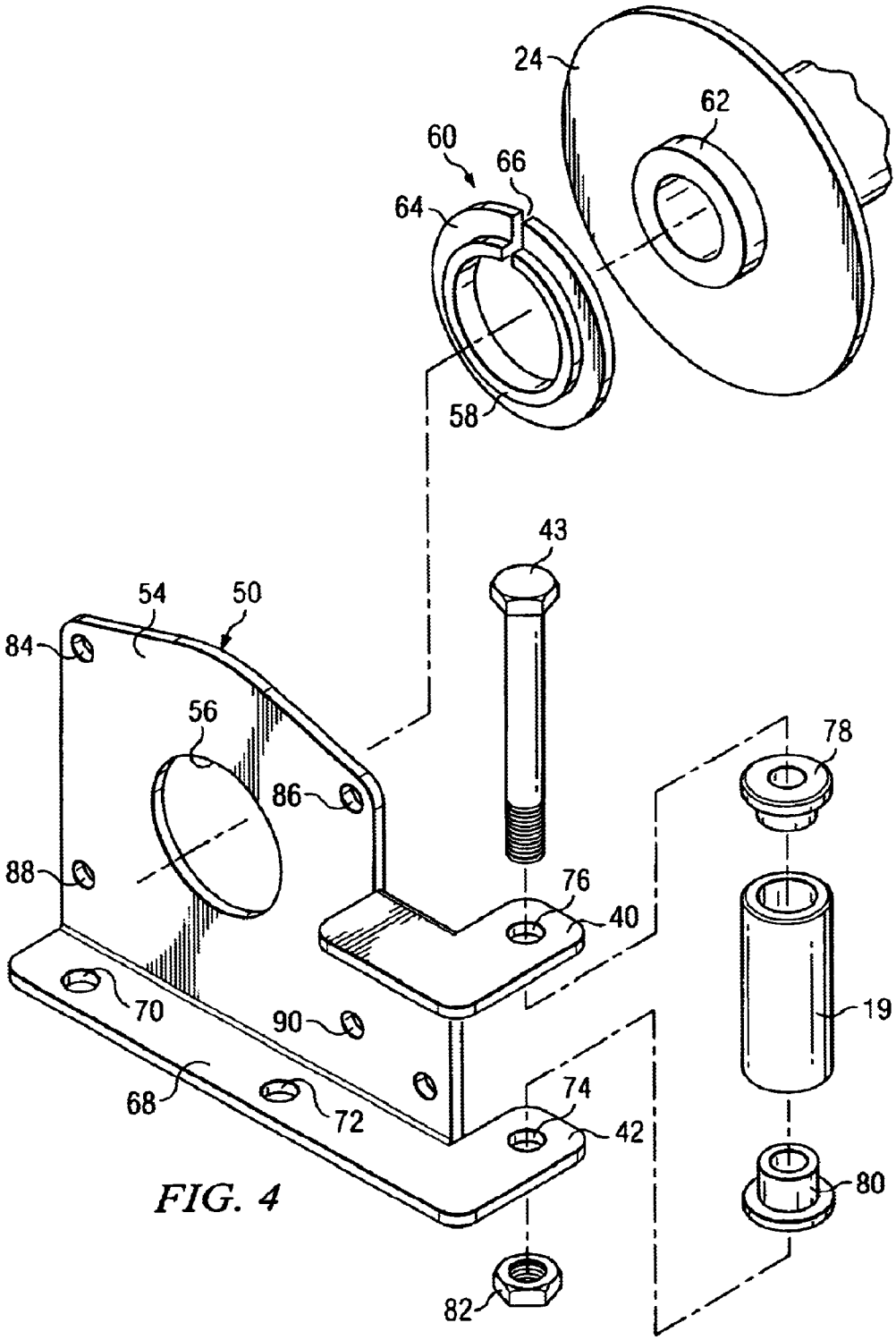
FIG. 4 is an exploded view of a portion of the winch fairlead frame supporting a cable drum spindle in a bearing.
Figure 5:
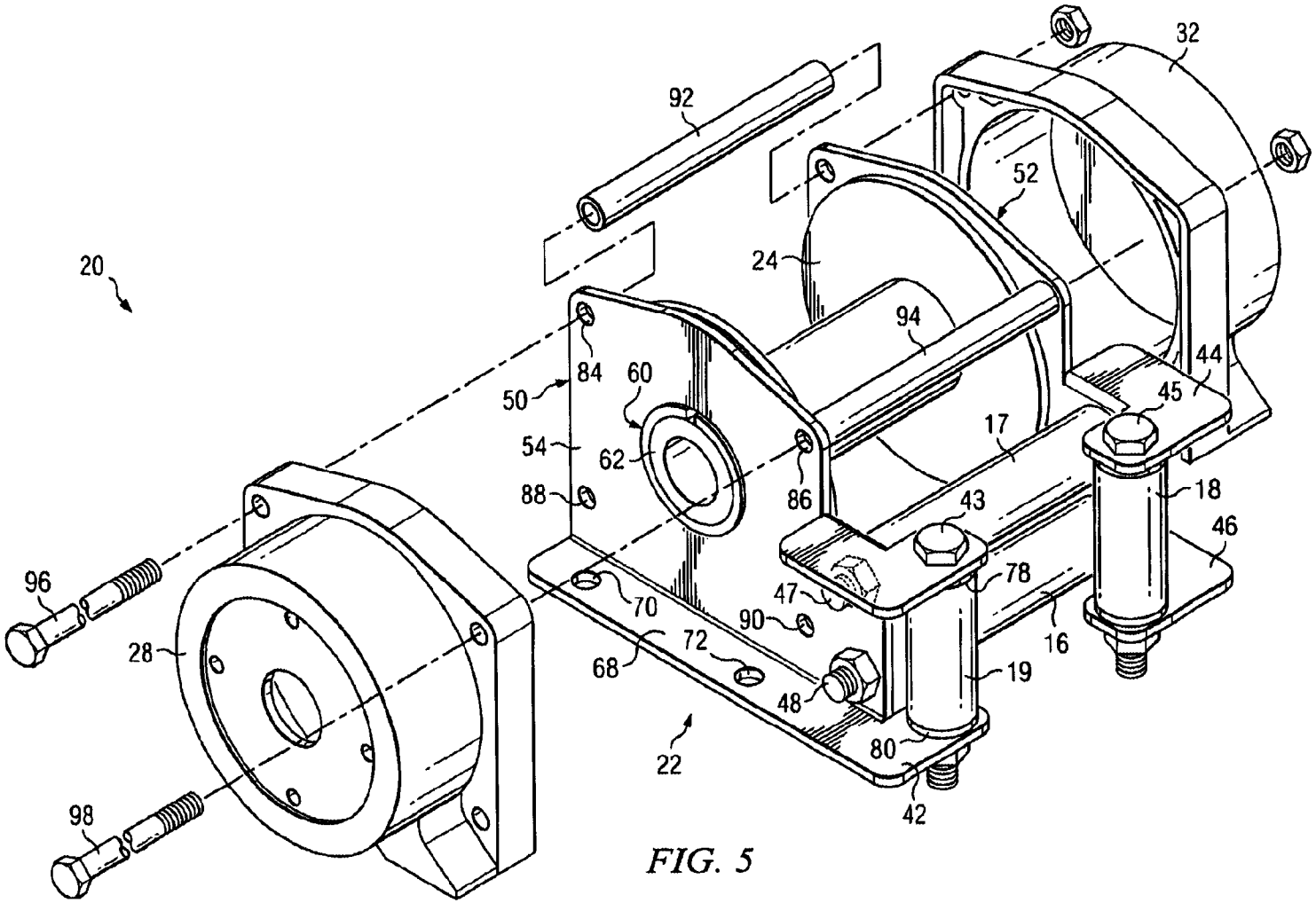
FIG. 5 is an exploded view of the major parts of the winch constructed in accordance with a preferred embodiment of the invention.

With reference now to FIGS. 4 and 5, there are shown in more detail the structural features of the fairlead, as assembled integral with the winch 20. FIG. 4 illustrates the left fairlead frame member 50, it being realized that the right fairlead frame member 52 is constructed in an identical manner, as a mirror image. The left fairlead frame member 50 is constructed of a heavy duty steel suitable for withstanding the forces imposed thereon by loads attached to the winch cable 14. The fairlead frame member 50 is constructed from a single plate of steel, composite material or plastic of suitable strength, and bent or otherwise formed or molded in the shape shown in FIG. 4. A vertical frame part 54 includes a large central opening 56 for insertion therein of the collar 58 of a split nylon bearing 60. The cylindrical spindle 62 of the cable drum 24 fits within the opening of the bearing collar 58. In order to provide an axial thrust bearing between the vertical plate 54 and the cable drum 24, an annular flange 64 is formed as part of the nylon bearing 60. The nylon bearing 60 includes a slit 66 therethrough so as to allow the collar 58 to conform between the annular edge of the plate opening 56 and the cable drum spindle 62.

A bottom lateral part 68 of the left fairlead frame member 50 includes a pair of holes 70 and 72 for mounting to the frame of a vehicle, or in the alternative to the auxiliary mounting bracket 51 for interfacing the winch 20 to various types of vehicles. Formed as part of the lateral frame member part 68 is the ear 42 with a hole 74 formed therein. Spaced upwardly from the bottom ear 42 is the top ear 40, which is also formed as part of the vertical plate 54: The hole 76 in the top ear 40 is aligned with the hole 74 in the bottom ear 42. A steel roller 19 includes a top nylon insert 78 and the bottom nylon insert 80, which inserts function as respective bearing supports for the top end and bottom end of the elongate, tubular roller 19. The bolt 43 passes through the top hole 76 of the top ear 40, through the top bearing 78, then the roller 19 and bottom bearing 80, and through the hole 74 in the bottom ear 42. The top and bottom nylon bearings 78 and 80 include reduced-diameter shanks which fit within the top opening and bottom opening of the roller 19. Lastly, a nut 82 of the self locking type is threaded onto the threads of the bolt 43 to secure the roller 19 in place. The selflocking nut 82 is of a conventional type such that it does not have to be substantially tightened on the threads of the bolt 43, and thus allows the roller 19 to rotate freely. The nut 82 can be of the aircraft type having a nylon part which becomes friction fit with the threads of the bolt 43.

The vertical plate 54 of the frame member 50 includes upper holes 84 and 86, as well as lower holes 88 and 90. The function of the holes 88 and 90 will be described below. The vertical frame member part 54 further includes a pair of holes drilled therein for supporting the bolts 47 and 48 (FIG. 3) that mount the horizontal rollers 16 and 17 between the left and right fairlead frame members 50 and 52.

With reference now to FIG. 5, there is illustrated an exploded view of a portion of the components of the winch 20 constructed according to the invention. The cable drum 24 includes bearing spindles on each side thereof which fit within the respective nylon bearings (one shown as reference numeral 60), supported within the respective fairlead frame members 50 and 52. The cable drum 24 is preferably constructed of a heavy duty aluminum material, suitable for withstanding the forces exerted thereon by the cable 14. The fairlead frame members 50 and 52 are held in a spaced-apart manner by a pair of upper tubular spacers 92 and 94. The tubular spacers 92 and 94 are of a sufficient length such that the cable drum 24 has a small degree of axial play between the frame members 50 and 52. Respective bolts 96 and 98 pass through the top holes of the motor ring gear housing 28, and through the top holes 84 and 86 of the left fairlead frame member 50. The bolts 96 and 98 also pass through the respective tubular spacers 94 and 96, through the upper holes of the right fairlead frame member 52, and are threaded into respective nuts to hold such components together. A pair of short bolts (not shown) also pass through the two bottom holes of the motor ring gear housing 28 and are fastened into the respective threaded holes 88 and 90 of the left fairlead frame member 50. In like manner, another pair of short bolts (not shown) pass through the bottom holes of the clutch ring gear housing 32 and are threaded into respective holes of the right fairlead frame member 52. As noted above, the various planetary gears are mounted within the motor ring gear housing 28, and connected by way of a shaft (not shown) that extends through the central opening of the cable drum 24 for connection to other planetary gears mounted within the clutch ring gear housing 32. The motor is mounted to the face of the motor ring gear housing 28. The shaft of the motor is connected in the conventional manner to the gear reduction apparatus. Many other types of gear mechanisms can be employed.

It should be understood that while the preferred embodiment of the winch 20 employs a fairlead with rollers, other structures providing similar functions can be used. For example, rather than using rollers, a hawse can be mounted to the fairlead frame members to provide an entrance opening with smooth surfaces to prevent abraiding of the cable strands.

From the foregoing, a winch construction is disclosed, where the cable drum bearing frame and the fairlead frame are made integral, thereby facilitating assembly of the winch. In addition, the integral cable drum bearing frame and the fairlead frame provide a base for the winch, for mounting to the frame of a vehicle or other mounting apparatus.

While the preferred embodiment of the invention has been disclosed with reference to a specific winch and method of construction thereof, it is to be understood that many changes in detail may be made as a matter of design choices, without departing from the spirit and scope of the invention, as defined by the appended claims.

What is claimed is:

1. A winch, comprising:

a cable drum rotatable for winding and unwinding a cable therefrom;

a fairlead frame including spaced-apart frame members, each said fairlead frame member being a unitary piece of material and adapted for journaled rotation of said cable drum therein, wherein cable loads exerted on said cable drum are transferred to said fairlead frame members; and said fairlead frame members each having a first edge with a flange for mounting the winch to another anchor structure and a second different edge of each fairlead frame member for supporting a cable guide with an opening therein for routing the cable onto said cable drum.

2. The winch of claim 1, wherein said fairlead frame members are constructed as two different members.

3. The winch of claim 2, wherein each said fairlead frame member is a mirror image of each other.

4. The winch of claim 1, wherein said fairlead frame members include a plate having a respective bore formed therein for a rotatably supporting a cable drum spindle, and wherein each said fairlead frame member includes a vertical member integral therewith for mounting therebetween a pair of horizontal rollers, and each said fairlead frame member including a pair of horizontal members integral therewith for mounting therebetween a respective vertical roller.

5. The winch of claim 1, wherein said fairlead frame members are constructed and mounted to said winch as parallel plates, spaced apart from each other with said cable drum rotatable therebetween, each said parallel plate including abase part orthogonal thereto with holes therein for mounting said winch to other apparatus, and further including an ear formed on each said parallel plate, each said ear being generally parallel to the orthogonal base part, and each said parallel plate supporting a roller between a respective ear and the base part.

6. The winch of claim 5, further including a pair of rollers mounted for rotation between said parallel plates.

7. The winch of claim 5, further including a pair of ring gear housings, each having an internal annular surface with gear teeth formed therein, each said ring gear housing being formed of a moldable synthetic material, and each said ring gear housing being mounted to a respective said parallel plate of said fair lead frame.

8. The winch of claim 7, wherein each said ring gear housing is formed of a nylon material.

9. The winch of claim 8, wherein each said ring gear housing is formed of a nylon 6/6 material.

10. The winch of claim 1, further including a mounting plate formed of a light weight non-metallic material, said fairlead frame members being adapted for mounting to said mounting plate.

11. The winch of claim 10, wherein said mounting plate is formed of a carbon fiber material.

12. The winch of claim 11, wherein said mounting plate is adapted for mounting the winch to an all-terrain vehicle.

13. The winch of claim 1, wherein said cable guide, comprises two or more rollers.

14. The winch of claim 1, wherein said cable guide comprises a hawse.

15. A winch, comprising:

a cable drum rotatable for winding and unwinding a cable therefrom, said cable drum having a spindle;

a pair of spaced-apart fairlead frame members for rotatably supporting said cable drum therebetween;

each said fairlead frame member being a unitary plate of material formed to provide a base for bolting said winch to other apparatus;

a first vertical roller having a first end and a second end fastened to one said fairlead frame member, and a second vertical roller having a first end and a second end fastened to the other fairlead frame member;

a pair of horizontal rollers having respective first ends and second ends fastened to said pair of spaced-apart fairlead frame members, wherein the same unitary plate of material that rotatably supports said cable drum also provides the plate to which the vertical and horizontal rollers are fixed for rotation;

said horizontal and vertical rollers for guiding the cable onto said cable drum;

at least one ring gear housing formed of a moldable synthetic material mounted to one said fairlead frame member;

a gear reduction mechanism engaged with said ring gear housing and coupled to said cable drums; and a motor for driving said gear reduction mechanism.

16. The winch of claim 15, wherein each said unitary plate includes a pair of spaced apart ears for supporting a respective vertical roller, and each said unitary plate includes a pair of holes therein for use with bolts for supporting a corresponding pair of horizontal rollers.

17. The winch of claim 15, further including a carbon fiber mounting plate for mounting thereto said fairlead frame members.

18. The winch of claim 15, wherein each said unitary plate of material includes:

a planar portion with a bore therein for use in journaled rotation of said cable drum;

a lateral portion formed perpendicular to said planar portion, said lateral portion having holes therein for mounting the winch to other apparatus, and a hole therein for fixing an end of a vertical roller thereto;

an ear formed perpendicular to said planar portion and parallel to said lateral portion, said ear having a hole therein for fixing an end of a vertical roller thereto; and said planar portion having two vertically spaced-apart holes therein for fixing thereto ends of respective horizontal rollers.

19. The winch of claim 18, wherein said lateral portion and said ear are formed by bending said unitary plate of material.

20. The winch of claim 18, wherein said ear is shorter in length than said lateral portion, as measured in a direction orthogonal to an axis of rotation of said cable drum.

* * * * *